US005816902A

United States Patent [19]

Watanabe et al.

[11] Patent Number: 5,816,902

[45] Date of Patent: Oct. 6, 1998

[54] ABRASIVE SHEET AND METHOD OF MANUFACTURING SAME

[75] Inventors: Nobuyoshi Watanabe; Takashi Fujii; Masashi Hara; Hisatomo Ohno; Makoto Kuwabara, all of Tokyo, Japan

[73] Assignee: Nihon Micro Coating Co., Ltd., Japan

[21] Appl. No.: 789,422

[22] Filed: Jan. 29, 1997

Related U.S. Application Data

[63] Continuation-in-part of Ser. No. 535,161, filed as PCT/JP95/253 Feb. 22, 1995, abandoned.

[30] Foreign Application Priority Data

Feb. 22, 1994 [JP] Japan ..... 6-046553
Jul. 29, 1994 [JP] Japan ..... 6-196268

[51] Int. Cl.[6] ..... B24D 11/00; B32B 33/00

[52] U.S. Cl. ..... 451/532; 51/295; 51/307; 51/309; 427/174; 427/180; 427/198; 427/276; 427/428; 428/87; 451/534; 451/539

[58] Field of Search ..... 51/295, 307, 309; 427/174, 180, 198, 276, 428; 428/87; 451/532, 534, 539

[56] References Cited

U.S. PATENT DOCUMENTS

| | | | |
|---|---|---|---|
| Re. 31,745 | 11/1984 | Pickelmon | 451/532 |
| 2,347,244 | 4/1944 | Colt et al. | 451/532 |
| 3,758,393 | 3/1973 | Smith | 451/532 |
| 4,477,938 | 10/1984 | Rogut | 451/532 |
| 4,841,684 | 6/1989 | Hall | 451/532 |
| 4,908,252 | 3/1990 | Carnahan | 428/87 |

*Primary Examiner*—James C. Cannon
*Attorney, Agent, or Firm*—Majestic, Parsons, Siebert & Hsue

[57] ABSTRACT

An abrasive sheet for fine texture processing has threads planted uniformly on a surface of a flexible base sheet and abrasive particles are attached by a binder to each of these threads uniformly over a specified distance from the tip such that the threads remain free to move independently without getting stuck to each other. Such an abrasive sheet can be manufactured by gravure processing with the separation between a gravure roller and a back roller adjusted according to the distance over which a coating material including the abrasive particles can be applied to the threads.

20 Claims, 6 Drawing Sheets

ABRASIVE SHEET AND METHOD OF MANUFACTURING SAME

This is a continuation-in-part of application Ser. No. 08/535,161 filed Dec. 15, 1995, now abandoned.

BACKGROUND OF THE INVENTION

This invention relates to abrasive sheets and, in particular, to abrasive sheets used for precision working or processing such as texture processing of a hard disc surface. This invention also relates to methods of manufacturing such abrasive sheets.

Hard discs are commonly used as magnetic memory media for computers and the like. Texture processing is carried out on the surface of such a hard disc in order to form microscopic grooves for the purpose of recording stability and durability as well as for preventing contact of a read/write (R/W) head with the hard disc surface.

For the texture processing of a hard disc, it has been known (as disclosed, for example, in Japanese Patent Application Tokugan 4-86669) to use an abrasive sheet made simply by coating a base sheet of PET (polyethylene terephthalate) or a fabric with a mixture of abrasive particles and a binder. It has also been known to carry out texture processing by using an abrasive pad and a suspension with abrasive particles dispersed as loose grinding particles in a water solution.

With the recent trend towards increased memory capacity of hard discs, higher-density storage of data is coming to be required. The floating distance of a R/W head is similarly required to be reduced above the hard disc surface. Thus, texture processing must now be carried out with increased precision and uniformity. If texture processing is carried out by using a prior art abrasive sheet, relatively high or abnormal protrusions are likely to be formed on hard disc surfaces, there resulting microscratches at the same time. In other words, microscopically uniform texture processing could not be achieved on a hard disc surface with a prior art abrasive sheet.

If loose abrasive particles are used for the texture processing of a hard disc surface, on the other hand, microscopic waviness is likely to be formed on the hard disc surface. If the particle size is reduced, however, the line density of grooves cannot be made sufficiently small and there will be an additional job of removing loose residual particles after the processing is finished.

If high spots are formed after the texture processing of a hard disc surface, they will collide with the R/W head when the disc is actually used, causing a loss of stored data and generating noise. The floating distance of the R/W head cannot be made small in a stabilized manner. No accurate recording is possible in such a situation, much less any increase in the memory capacity of a disc.

As the recording density is increased, furthermore, the area per recording signal (or a bit cell) becomes smaller. Microscratches on the hard disc surface in such a situation will result in lost signals and errors in recorded information. If there is waviness on the hard disc surface, no matter how small, the separation between the R/W head and the disc surface is not constant, and the signal intensity becomes unstable, causing noise. If the line density by texture processing is small, the R/W head tends to be adsorbed to the hard disc surface when its motion stops, making it difficult to restart the operation, and loose abrasive particles remaining on the hard disc surface tend to cause signal errors. In summary, non-uniformity on the hard disc surface, such as high or abnormal protrusions, microscratches, waviness, low line density and residual loose particles all affect adversely the capability of a hard disc as its recording capacity is increased.

Such non-uniformity is considered to be due to the lack of elasticity in the base sheet. It is because, if the base sheet is not sufficiently elastic, abrasive particles projecting from the sheet tend to dig more deeply into the disc surface than desirable, producing abnormally high protrusions. It may be also due to remaining debris from the texture processing, scratching the hard disc surface deeply to cause anomalous spots.

Prior art abrasive sheets as disclosed, for example, in aforementioned Japanese Patent Application Tokugan 4-86669 make use of a nonwoven fabric as the base sheet in order to provide elasticity, but since the abrasive layer is formed simply by uniformly coating the base sheet with a mixture of abrasive particles and a binder, grooves must be formed on the sheet in order to discharge the debris.

SUMMARY OF THE INVENTION

It is generally an object of this invention to provide an abrasive sheet having a specified abrasive force.

It is another general object of this invention to provide an abrasive sheet capable of abrading a workpiece surface finely and uniformly to a specified degree of roughness and simultaneously removing abrasion chips.

It is a more specific object of this invention to provide an abrasive sheet capable of uniformly abrading a workpiece surface to attain a specified roughness and simultaneously removing abrasion chips from the surface.

It is another object of this invention to provide an elastic abrasive sheet using a thread-planted sheet of which the planted threads have abrasive particles attached to them and are mutually separated and free to move mutually independently, having no uniformly affixed abrasive layer formed on the surface of the thread-planted sheet.

It is still another object of this invention to provide an elastic abrasive sheet using a thread-planted sheet so made that the planted threads have a uniform height, that the threads are not stuck to each other with a coating material attached to where they intersect, and that abrasive particles are attached to the threads so as to allow the threads to move independently and freely (that is, the abrasive particles are attached so as to be movable with respect to the base sheet).

It is a further object of this invention to provide a method of manufacturing such an abrasive sheet as described above.

An abrasive sheet embodying this invention, with which the above and other objects can be accomplished, may be characterized as comprising a base sheet, threads which are evenly planted to the base sheet, and abrasive particles attached evenly to the threads by a binder. The threads are mutually separated such that, when the sheet is used for abrading a surface of a workpiece, these threads can move independently and individually, and that debris from the abraded surface can be taken into spaces between these threads.

Such an abrasive sheet can be manufactured by preparing a thread-planted sheet by planting threads evenly over a surface of an elastic base sheet, preparing a coating material by mixing abrasive particles with a binder, and coating this surface with the coating material such that the abrasive particles adhere evenly to the threads.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Abrasive sheets according to this invention are characterized wherein a coating material obtained by mixing and stirring together abrasive particles and a binder is applied to the threads of a thread-planted sheet such that these abrasive particles are attached to each of the threads which are mutually separate and capable of moving independently and individually. Such abrasive sheets can be manufactured by coating the threads of a thread-planted sheet with such a coating material.

Examples of the fiber materials for the threads include nylon, polypropylene, polyethylene, polyethylene terephthalate, polyurethane, glass, carbon and metals. The threads are preferably 0.1–10 d in thickness and 0.1–1.0 mm in length, and the density of the threads on the thread-planted sheet is preferably 50–2000 /mm$^2$. If they are too thick or too short, they cannot be sufficiently elastic. If they are too thin or too long, they cannot be individually independent and tend to become entangled such that abrasive particles cannot be attached to them individually.

Examples of abrasive particles include $Al_2O_3$, SiC, diamond, $Cr_2O_3$ and $CeO_2$, but $Al_2O_3$ and SiC are preferred.

Examples of the binder include polyester resins, polyurethane resins, copolymerized vinyl resins, epoxy resins, phenol resins, those obtained by reacting their mixture with a hardening agent, and water-soluble resins. Such a binder is dissolved in a solvent such as toluene, xylene, methyl ethyl ketone (MEK), methyl isobutyl ketone (MIBK), ethyl acetate, cyclohexane, acetone, alcohol, water and their mixture.

Figure 3A:
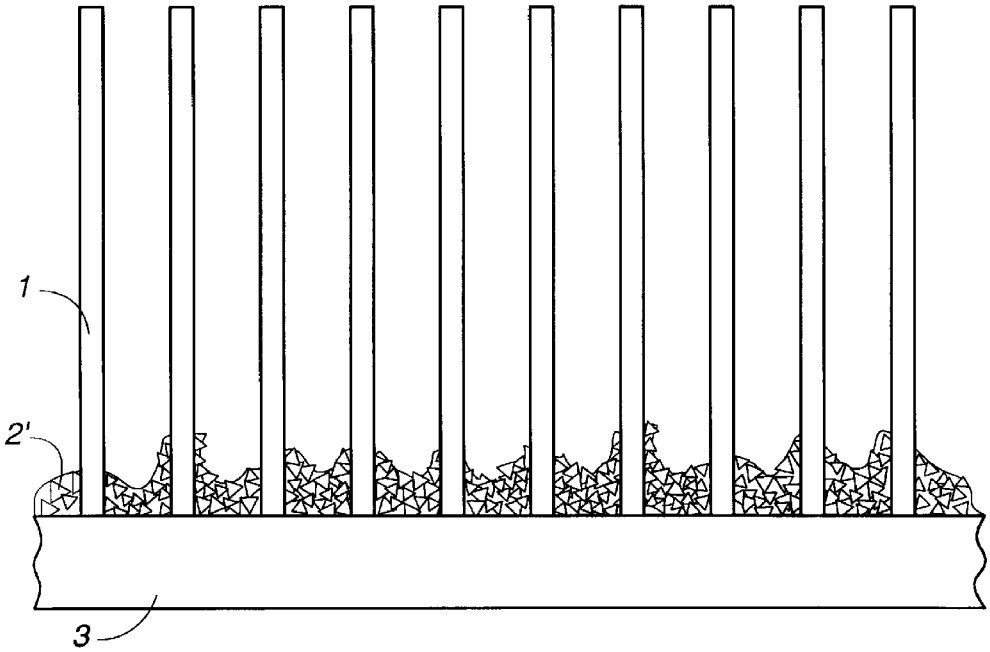
FIGS. 3A and 3B are views of coating material on threads, FIG. 3A showing when the viscosity of the coating material is too large, and FIG. 3B showing when the viscosity of the coating material is too small.
Figure 3B:
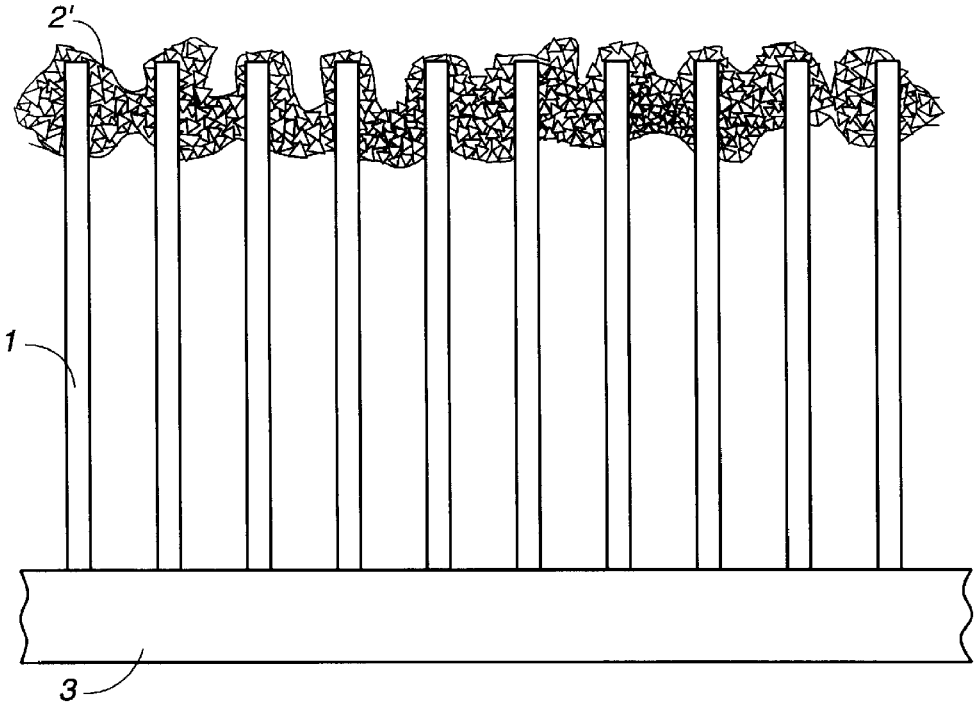

The viscosity of the coating material obtained by mixing and stirring abrasive particles with a binder to have them dispersed is preferably in the range of 20–300 cp, and more preferably 50–150 cp. FIGS. 3A and 3B show how a coating material 2' may be attached to a thread-planted sheet 3 when the viscosity of the coating material is respectively too low and too high. If the viscosity of the coating material 2' is lower than the range given above, the coating material 2' falls off from the tips of the threads 1, and the abrasive particles 2 fail to come into contact with a workpiece surface when abrading it. If the viscosity of the coating material 2' is higher than the range given above, the amount of the material 2' becomes excessive at the time of coating, forming big lumps at the tips of the threads 1. This will tend to make scratches on the workpiece surface. Preferable coating materials can be obtained by heating and drying abrasive particles with 60–98 weight % of $Al_2O_3$I mixing and stirring them with a binder obtained by dissolving 1–35 weight % of saturated polyester resin in a mixed solvent of toluene, xylene, ethyl acetate and MEK to disperse them and filtering. An isocyanate hardening agent is added to this material by 1–5 weight % immediately before the coating such that the viscosity will be adjusted to within the range of 30–150 cp.

The weight ratio of the abrasive particles in the coating material is preferably over 60%, and more preferably in the range of 80–98%. This is because the threads tend to stick together when the coating material comprising both abrasive particles and a binder is applied to the threads if the weight ratio of the abrasive particles with respect to the binder is too small, preventing the abrasive particles from getting attached to the individual threads.

A fabric or a plastic film sheet may be used as the base sheet, but a plastic film is more preferable as the base sheet of a thread-planted sheet. Examples of materials for such a plastic film sheet include PET (polyethylene terephthalate), PEN (polyethylene naphthalate), PPS (polyphenylene sulfide), PEI (polyether imide), PC (polycarbonate), PVC (polyvinyl chloride), PP (polypropylene), PVDC (polyvinylidene chloride), nylon, PE (polyethylene) and PES (polyether sulfone).

Figure 2:
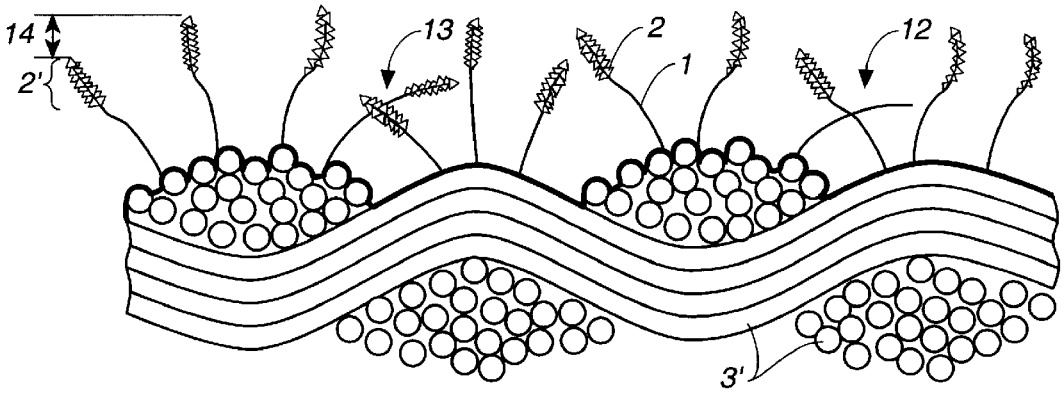
FIG. 2 is a sectional view of an abrasive sheet according to this invention with a fabric as its base sheet.

FIG. 2 shows an abrasive sheet using a fabric 3' as its base sheet. Because a fabric base sheet 3' has an uneven surface, there are height differences (indicated by numeral 14) among the threads 1. Because of the curving of the fabric surface, furthermore, the threads 1 may intersect each other (at positions indicated by numerals 12 and 13). The coating material 2' tends to get stuck at such intersections to attach two threads 1 together. As a results, there appear spots on the surface of the abrasive sheet where the threads 1 cannot move freely. This tends to adversely affect the elasticity of the abrasive sheet.

If a plastic sheet such as a PET film sheet is used as the base sheet, threads of equal length can be planted because the base sheet has a flat surface. Because plastic film sheets generally have a small tensile elongation, their thickness does not diminish when they are pulled. Thus, it is possible to coat only portions of the threads within a specified distance from the tips by pulling the thread-planted sheet such that the threads thereon will not mutually intersect. If such an abrasive sheet having a plastic film sheet as its base sheet is used to abrade a surface of a workpiece, say, of a metal or a plastic material, fine abrasion can be effected without giving rise to anomalous protrusions or waviness because there is no area on the sheet surface where the threads are intersected and stuck together. Since abrasion chips can be taken into the spaces between the threads, debris can be effectively removed from the workpiece surface. The coating material may be applied to the threads preferably by a gravure coating method, but it may be by a spray coating or electrocoating method.

According to the gravure coating method, a coating material prepared by mixing and stirring abrasive particles with a binder to have the abrasive particles dispersed is applied to a gravure roller. A thread-planted sheet is wound tightly on a backup roller positioned opposite to the gravure roller such that the threads stand up towards the gravure roller. The coating material is then applied to the thread-planted sheet by transporting the thread-planted sheet between the gravure roller and the backup roller after varying the distance between the roller to thereby adjust the distance over which the coating material is applied.

The advantage of using a plastic film sheet for the base sheet is that it can be bent into a U-shape over the backup roller for causing the threads to stand up without affecting its thickness because the tensile elongation of the plastic film sheet is small. Thus, the lengths of the portions of the threads to be coated can be made uniform and the threads can be prevented from intersecting each other. As a result, the degree of freedom of motion of the threads is increased, the threads being able to move freely and individually.

Gravure rollers may be of a matrix type or a cross line type. Their shape does not limit the scope of this invention, but the number of lines, depth and the cell capacity have significant effects on the amount of the coating material applied to the threads. If too much coating material is applied, the threads tend to intersect and get stuck to each other. If the amount is too small, not enough abrasive particles necessary for abrading can be attached to each thread. The number of lines on the gravure roller is preferably 50–200 per inch, its depth preferably in the range of 30–200 $\mu$m and the cell capacity preferably in the range of 8–100 $\mu m^3/m^2$. In the gravure coating process, the peripheral speed of the gravure roller is preferably 40–90%, and more preferably 50–80%, of the traveling speed of the thread-planted sheet. This is because, if the peripheral speed of the gravure roller is made slower than the speed of the thread-planted sheet, the excess amount of the coating material applied to the threads can be scraped off by the hill portion of each line of the gravure roller, and the elastic property of the threads themselves can be used to make them stand up such that even intersecting threads can come apart by their motion.

Figure 1:
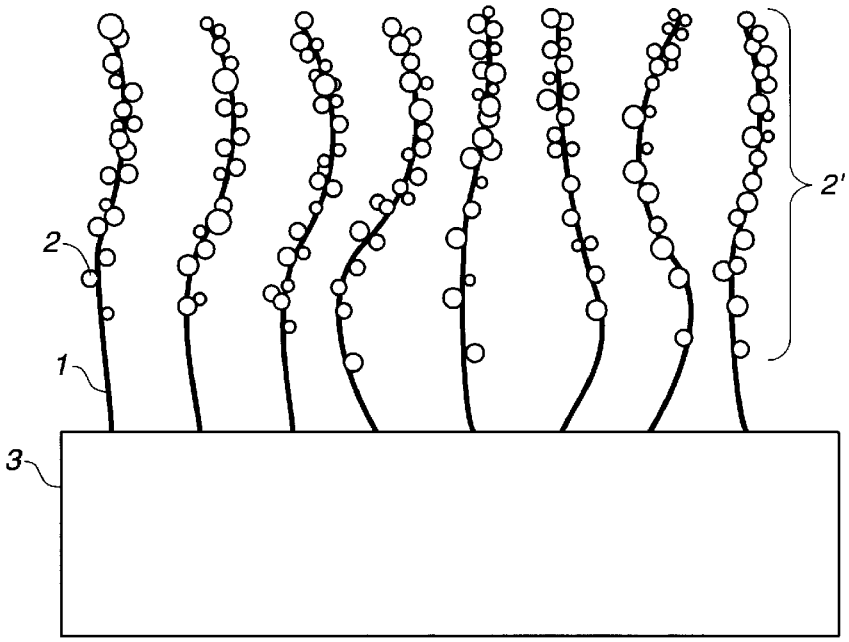
FIG. 1 is a sectional view of a portion of an abrasive sheet embodying this invention.

As shown in FIG. 1, an abrasive sheet according to this invention is characterized firstly as having abrasive particles 2 attached to each of threads 1 of a thread-planted sheet. The thread-planted sheet is obtained by planting threads, comprising fibers such as nylon fibers, on a flexible thin base sheet 3 which may be a plastic film sheet such as a PET film sheet or a fabric sheet. Such an abrasive sheet may be manufactured by coating the threads 1 of such a thread-planted sheet with a coating material 2' obtained by mixing abrasive particles 2 with a binder and dispersing them. The coating material 2' is produced by drying the abrasive particles 2, mixing and stirring these abrasive particles 2 with a binder, and causing them to be dispersed by means of a sand-mill or a ball-mill. An isocyanate hardening agent is added immediately before it is used for coating the thread-planted sheet. A gravure coating method is preferred, but the coating operation may be carried out by spraying or electrocoating.

The invention is described next by way of experiments carried out by producing abrasive sheets both by a method according to a preferred embodiment of this invention (test examples) and by some other method (comparison examples).

TEST EXAMPLE 1

After abrasive particles (1 kg) of $Al_2O_3$ with average diameter 2 $\mu$m were heated for one hour at 100° C. to be dried, they were mixed and stirred with a binder obtained by dissolving 310 g of saturated polyester resin in a mixed solvent of toluene, xylene, ethyl acetate and MEK, dispersed and filtered to obtain a coating material with viscosity 50 cp (weight ratio of abrasive particles=73%). An isocyanate hardening agent (60 g) was added immediately before the coating operation, and it was applied to a thread-planted sheet obtained by planting about 370 nylon threads per $mm^2$ of thickness 1.0 d and length 0.6 mm on a PET film sheet of thickness 50 $\mu$m by using a #50 gravure roller (with linear grooves at 45-degree angles at equal intervals therebetween). The abrasive sheet thus produced (Test Example 1) was used for texture processing of a hard disc surface and the results were compared with those with Comparison Examples 1 and 3, to be described below. The results are shown in Table 1.

TEST EXAMPLE 2

After abrasive particles (1 kg) of $Al_2O_3$ with average diameter 1.5 $\mu$m were heated for one hour at 100° C. to be dried, they were mixed and stirred with a binder obtained by dissolving 310 g of saturated polyester resin in a mixed solvent of toluene, xylene, ethyl acetate and MEK, dispersed and filtered to obtain a coating material with viscosity 50 cp (weight ratio of abrasive particles=73%). An isocyanate hardening agent (60 g) was added immediately before the coating operation, and it was applied to a thread-planted sheet obtained by planting 734 nylon threads per $mm_2$ of thickness 0.5 d and length 0.5 mm on a rayon fabric base sheet of thickness 50 $\mu$m by using a #50 gravure roller. The abrasive sheet thus produced (Test Example 2) was used for texture processing of a hard disc surface and the results were compared with those with Comparison Examples 2 and 4, to be described below. The results are shown in Table 2.

COMPARISON EXAMPLE 1

The coating material obtained according to Test Example 1 was applied on a PET film sheet of thickness 25 $\mu$m to form an abrasive layer of thickness 10 $\mu$m.

COMPARISON EXAMPLE 2

The coating material obtained according to Test Example 2 was applied on a PET film sheet of thickness 25 $\mu$m to form an abrasive layer of thickness 10 $\mu$m.

COMPARISON EXAMPLE 3

A suspension containing loose abrasive particles of $Al_2O_3$ with average diameter 2 $\mu$m was prepared for texture processing of a hard disc surface.

COMPARISON EXAMPLE 4

A suspension containing loose abrasive particles of $Al_2O_3$ with average diameter 1.5 $\mu$m was prepared for texture processing of a hard disc surface.

The hard discs used for texture processing were prepared by applying a Ni-P plating on a 3.5-inch aluminum disc and polishing its surface. A texturing machine produced by Nihon Micro Coating Co., Ltd. was used for the texture processing, and the surface roughness was measured by using a 0.2 $\mu$mR tracer P-1 (tradename by TENCOL).

The results of the measurements for the case of average particle diameter 2.0 $\mu$m are shown in Table 1 where Ra (in A °) is the average roughness on the central line, Rp (in A °) is the peak height on the central line, Wa (in Å) is the average waviness of the central line, Rp/Ra is the peak rate, Wa/Ra is the waviness rate, and Sm (in pm) is the average interval between peaks. The number of microscratches (N) is the number counted through a microscope at ten viewing positions. Smaller values of Rp/Ra indicate absence of anomalous projections. Smaller values of Wa/Ra indicate a uniform disc surface without waviness. Smaller values of Sm indicate a large line density.

TABLE 1

| | Ra | Rp/Ra | Wa/Ra | Sm | N |
|---|---|---|---|---|---|
| Test Example 1 | 64 | 3.1 | 0.34 | 1.9 | 4 |
| Comparison Example 1 | 69 | 4.6 | 0.33 | 1.9 | 2.8 |
| Comparison Example 3 | 52 | 3.1 | 0.40 | 2.4 | 3 |

TABLE 2

| | Ra | Rp/Ra | Wa/Ra | Sm | N |
|---|---|---|---|---|---|
| Test Example 2 | 50 | 3.2 | 0.35 | 1.8 | 4 |
| Comparison Example 2 | 33 | 4.3 | 0.33 | 1.7 | 16 |
| Comparison Example 4 | 30 | 3.1 | 0.40 | 2.3 | 2 |

Tables 1 and 2 clearly show that anomalous projections and microscratches are much fewer on the hard disc surfaces processed by using Test Examples 1 and 2 according to this invention. A comparison between Test Examples 1 and 2 with Comparison Examples 3 and 4 (with loose abrasive particles) shows that Test Examples can effectively reduce waviness and increase the line density, although the numbers of microscratches are about the same.

Figure 6:
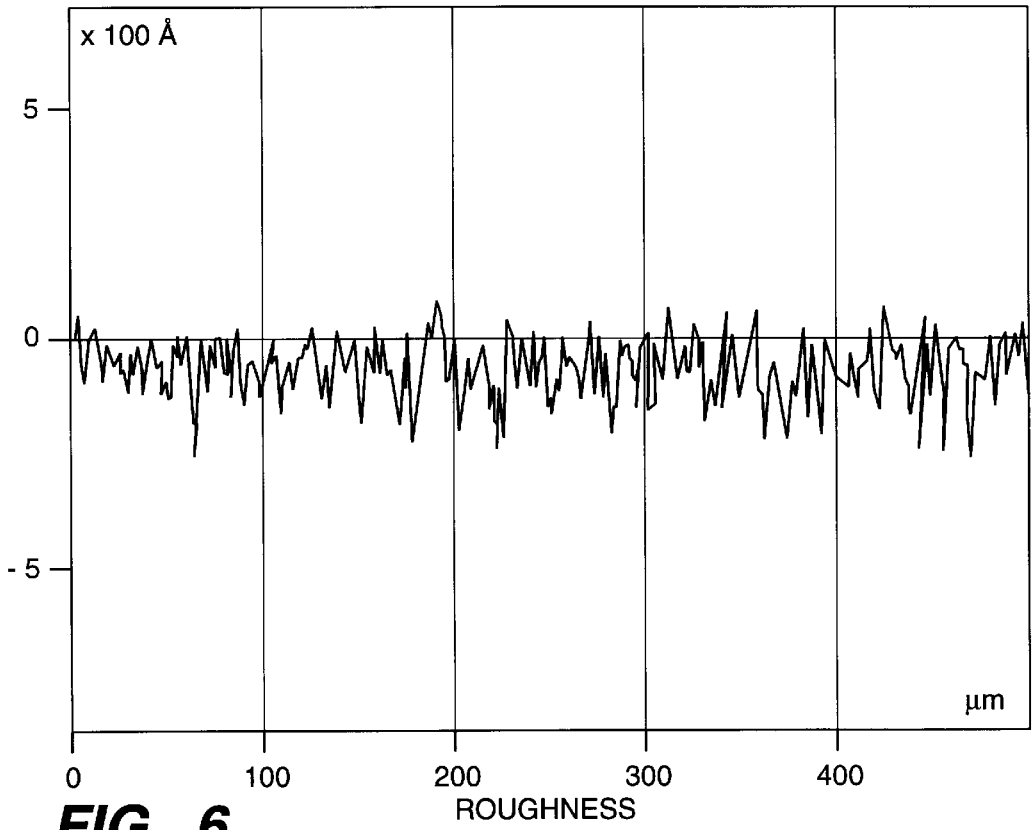
FIG. 6 is a drawing for showing the appearance of anomalous spots formed on a hard disc surface after texture processing was carried out by using an abrasive sheet embodying this invention.

FIG. 6 shows the unevenness on a hard disc surface textured by using an abrasive sheet according to this invention, indicating that the surface condition is mostly uniform. This means that abrasive sheets according to this invention can produce hard disc surfaces which are more uniform, having no waviness and with far less microscratches.

Figure 4:
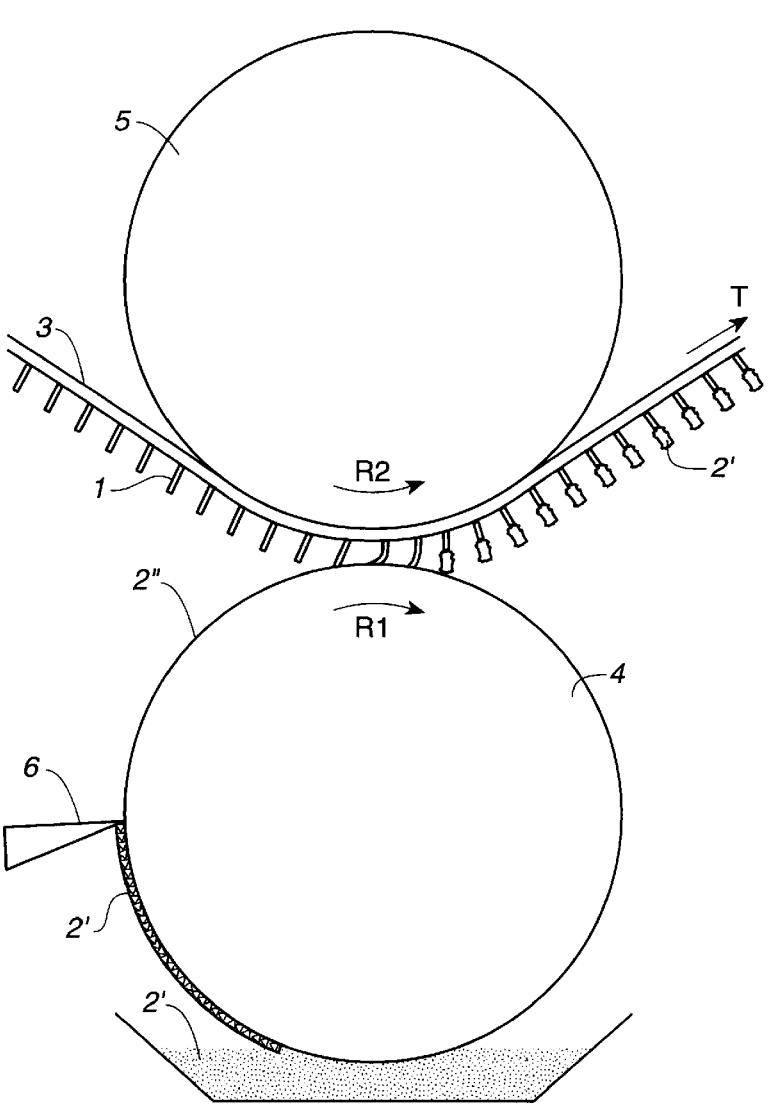
FIG. 4 is a schematic drawing of a gravure coating apparatus for manufacturing an abrasive sheet of this invention.

Abrasive sheets according to this invention are preferably manufactured by a gravure coating method by varying the distance between the gravure roller and the backup roller so as to adjust the coating length (that is, the length on which the coating is to take place) on the coating material on the threads. FIG. 4 shows a gravure coating apparatus which may be used for the production process according to this invention.

As schematically shown in FIG. 4, a gravure coating apparatus, which may be used for a method of production according to this invention, comprises a gravure roller 4 which is partially immersed in a coating material 2' having abrasive particles and an adhesive binder mixed together, a doctor blade 6 which is placed near the gravure roller 4 and serves to adjust the amount of the coating material applied to the gravure roller 4 such that a desired amount (indicated by numeral 2") of the coating material can be applied to the threads 1, and a back roller 5 which is placed opposite to and away from the gravure roller 4 and serves to cause the threads 1 to stand up in the direction of the gravure roller 4 by winding the thread-planted sheet around it in a U-shape to tighten it.

According to a preferred method of operation, the backup roller 5 is rotated (as shown by arrow R2 in FIG. 4) in the direction (shown by arrow T) of travel by the base sheet 3. The thread-planted sheet having a plastic film sheet such as a PET film sheet as its base sheet 3 is tightened in a U-shape around the backup roller 5 such that the threads 1 will stand up towards the gravure roller 4 without mutually intersecting while the base sheet 3 is transported in the direction of arrow T. At the same time, the gravure roller 4, which is partially immersed in the coating material 2', is caused to rotate in the direction of arrow R1, with the doctor blade 6 adjusting the amount of the coating material attached to the gravure roller 4, such that the coating material 2' is applied to the tip part of each of the threads 1 standing up on the traveling thread-planted sheet. The distance between the gravure roller 4 and the backup roller 5 is adjusted such that the coating material 2' is applied over a desired length on each thread 1. This is necessary because, as will be explained below more in detail, the abrasive force varies, depending on the distance on the threads over which the coating material is attached. Thus, the coating distance is properly adjusted for each occasion such that abrasive sheets suited for different purposes can be manufactured. For texture processing of a hard disc surface, abrasive sheets with a large abrasive force are usually used.

The abrasive sheet produced in Test Example 1 as described above will be hereinafter referred to as Abrasive Sheet A. Another abrasive sheet (Abrasive Sheet B) was produced by adding 60 g of the isocyanate hardening agent to the coating material used in Test Example 1 (viscosity=50 cp; weight ratio of abrasive particles=73%) immediately before it was applied to a thread-planted sheet obtained by planting 82 nylon threads (per $mm^2$) of thickness 1.0 d and length 0.6 mm on a rayon fabric base sheet of thickness 50 $\mu$m by using a #50 gravure roller. For the production of both Abrasive Sheets A and B, the distance between the gravure roller and the backup roller was adjusted such that a distance of 250 $\mu$m from the tip of each thread can be coated. Abrasive Sheets A and B were used to texture hard disc surfaces as explained above regarding Test Examples 1 and 2 and Comparison Examples 1–4. The results are shown in Table 3.

TABLE 3

| | Ra | Rp/Ra | Wa/Ra | Sm | N |
|---|---|---|---|---|---|
| Abrasive Sheet A | 64 | 2.9 | 0.34 | 1.9 | 2 |
| Abrasive Sheet B | 71 | 3.2 | 0.36 | 1.9 | 4 |

FIG. 3 shows that the use of a plastic film sheet as the base sheet (as with Abrasive Sheet A) has the effect of reducing the values of Rp/Ra and Wa/Ra as compared to the situation where a fabric sheet is used instead, or that a uniform hard disc surface with few anomalous projections and no waviness can be obtained.

Next, in the process of producing Abrasive Sheet A described above, the distance between the gravure roller and the backup roller was adjusted so as to vary the coating length from the tips of the threads from 250 $\mu$m to 200 $\mu$m, 150 $\mu$m and 100 $\mu$m to prepare additional sample sheets. These additional sample sheets were similarly used for texture processing of a hard disc surface and the values of Ra were measured. The results are shown in Table 4.

TABLE 4

| Coating Length from the Tip ($\mu$m) | Ra (Å) |
|---|---|
| 250 | 64 |
| 200 | 60 |
| 150 | 54 |
| 100 | 47 |

Table 4 shows that the abrasive force can be increased by adjusting the distance between the gravure roller and the backup roller to increase the coating distance from the tips of the threads.

Figure 5:
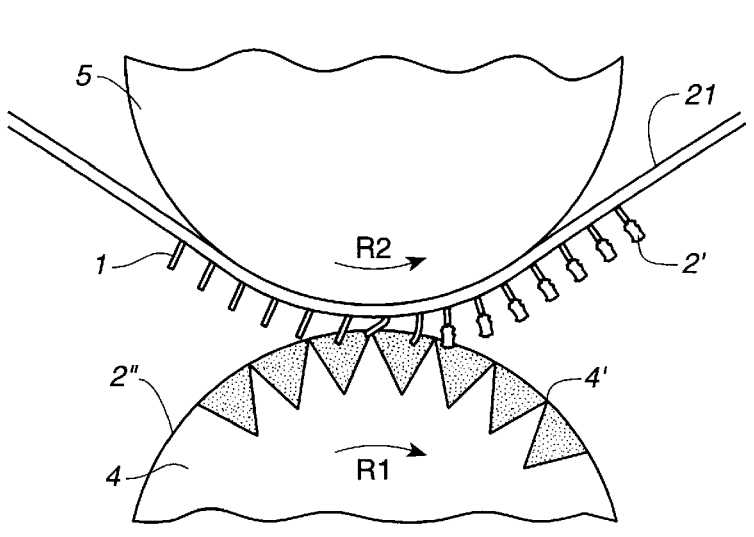
FIG. 5 is a portion of FIG. 4 when an extra amount of the coating material is being removed from each thread.

According to a further preferable embodiment of the invention, not only the distance between the gravure roller and the backup roller but also the peripheral speed of the gravure roller (shown by arrow R2 in FIG. 4) and the travel speed of the thread-planted sheet (which is the same as the peripheral speed of the backup roller shown by arrow R2) are varied. Although it has been known to vary the peripheral speeds of the gravure roller and the backup roller for the purpose of adjusting the amount of the coating material to be applied to the base sheet or to erase lines formed by the projecting portions of the lines on the gravure roller, the present invention achieves, as shown in FIG. 5, the removal of excess coating material from the threads 1 by using the projecting parts 4' of the gravure roller 4. The elasticity of the threads 1 themselves can also be utilized in order to prevent them from intersecting and becoming stuck with each other.

Thus, the so-called direct gravure coating method is preferred because the excess amount of coating material can be scraped off and the threads are allowed to move by their own elastic force. Although an elastic roller covered with a rubber material is usually used as the backup roller and the coating process is carried out by varying the contact area between the gravure roller and the backup roller by controlling the so-call nip pressure (the compressive pressure against the gravure roller), since the gravure roller and the backup roller are separated according to preferred embodiments of this invention, as shown in FIGS. 4 and 5, it is desirable to use a roller of a harder rubber material with hardness in excess of 60 duro or a non-elastic metallic roller as the backup roller because, if the backup roller is too soft, the distance between the gravure roller and the backup roller may change when the threads are tightened on the backup roller.

As another example of the present invention, Abrasive Sheet C was prepared by heating 1 kg of abrasive particles of $Al_2O_3$ with average diameter 2 $\mu$m for one hour at 100° C. for drying, mixing and stirring them with a binder obtained by dissolving 95 g of saturated polyester resin in a mixed solvent of toluene, xylene, ethyl acetate and MEK, dispersing and filtering them to obtain a coating material with viscosity 90 cp (weight ratio of abrasive particles= 90%), and adding 16 g of an isocyanate hardening agent immediately before coating therewith a thread-planted sheet obtained by planting 370 nylon threads (per $mm^2$) of thickness 1.0 d and length 0.6 mm on a PET film sheet of thickness 50 $\mu$m by using a #50 gravure roller. The distance between the gravure roller and the backup roller was adjusted to 500 $\mu$m (the coating length being 350 $\mu$m). The peripheral speed of the gravure roller was 70% (4.2 m/min) of the speed of travel (6.0 m/min) of the base sheet. The line density of the gravure roller was 150/inch, its depth was 47 $\mu$m, and its cell capacity was 21.7 $cm^3/m^2$. The weight ratio between the abrasive particles and the binder was 9:1.

The lump percentage (%) on the surface of Abrasive Sheet C (indicative of the degree to which the threads are stuck together at intersections to form lumps) was evaluated by taking a photograph of the surface at magnification of 30 and calculating the ratio (%) of areas occupied by the lumps of the coating material in an area of 50 mm×50 mm on the photograph.

Next, Abrasive Sheet C was used under the conditions shown in Table 5 to carry out texture processing on a 3.5-inch hard disc. The textured hard disc surface was enlarged by a microscope and scanned radially from the inner periphery to the outer periphery by a width of 0.25 mm to count the number of microscratches (that is, marks greater than 2 $\mu$m×10 $\mu$m).

Abrasive Sheets D, E, F and G were further prepared similarly, but by varying the viscosity of the coating material (to 170 cp) and the weight ratio of the abrasive particles (to 90%, 80%, 73% and 60% for Abrasive Sheets D, E, F and G, respectively). The lump percentages of these samples were already measured, and they were used again under the conditions of Table 5 for texture processing of 3.5-inch hard disc surfaces to count the numbers of microscratches. The test results are shown in Table 6. Since the tested area in this series of experiments was 15 times greater than for Test Examples 1 and 2 and Comparison Examples 1–4 described above, the numbers of microscratches divided by 15 are also shown in parentheses in Table 6 for the purpose of comparison.

TABLE 5

| | |
|---|---|
| Time of abrading: | 20 seconds |
| Travel speed of abrasive sheet: | 50 cm/min |
| Rotational speed of hard disc: | 200 rpm |
| Oscillation: | 160 cycle/min (width: 1 mm) |
| Interior pressure on disc: | 1.0 kg |
| Exterior pressure on disc: | 1.2 kg |
| Hardness of rubber | 40 duro |
| Coolant: | MIPOX No. 55G (Trademark) (3% dilution) |

TABLE 6

| | Lump Percentage (%) | Number of Microscratches |
|---|---|---|
| Abrasive Sheet C | 2.30 | 21 (1.40) |
| Abrasive Sheet D | 2.44 | 23 (1.53) |
| Abrasive Sheet E | 4.40 | 35 (2.33) |
| Abrasive Sheet F | 5.64 | 40 (2.67) |
| Abrasive Sheet G | 8.08 | 54 (3.60) |

Figure 7:
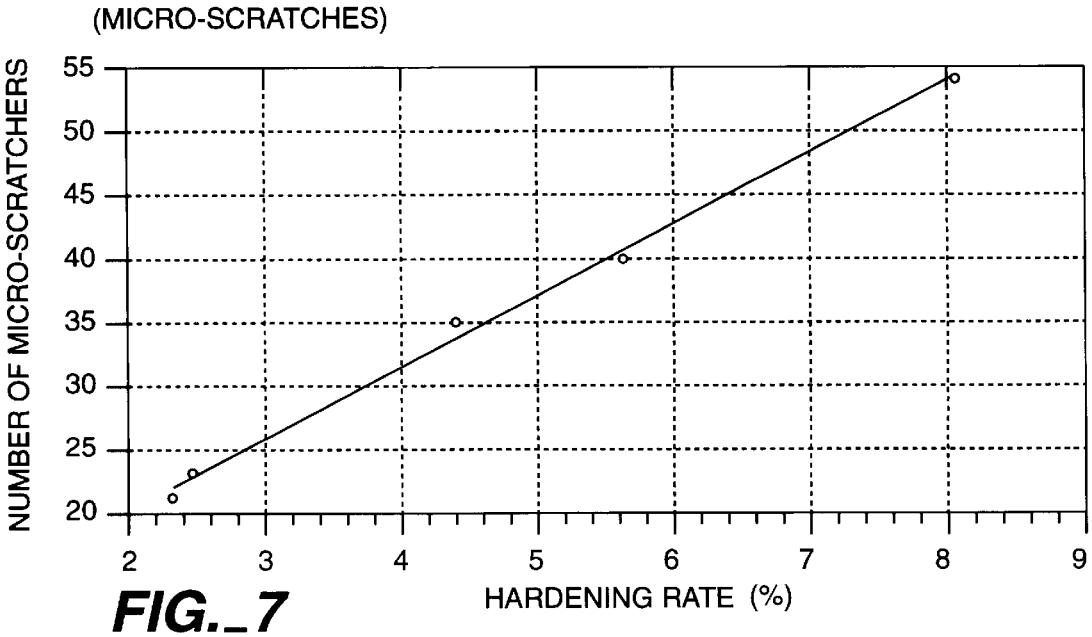
FIG. 7 is a graph showing the relationship between the lump percentage (%) and the number of microscratches.

The relationship between the lump percentage and the number of microscratches is shown in FIG. 7. It can be understood that they are proportional to each other, the number of microscratches increasing as the lump percentage becomes larger. Since the lump percentage can be made smaller by carefully choosing the viscosity of the coating material and the weight ratio of the abrasive particles, FIG. 7 shows that the number of microscratches on a textured hard disc surface can be reduced accordingly.

Figure 8A:
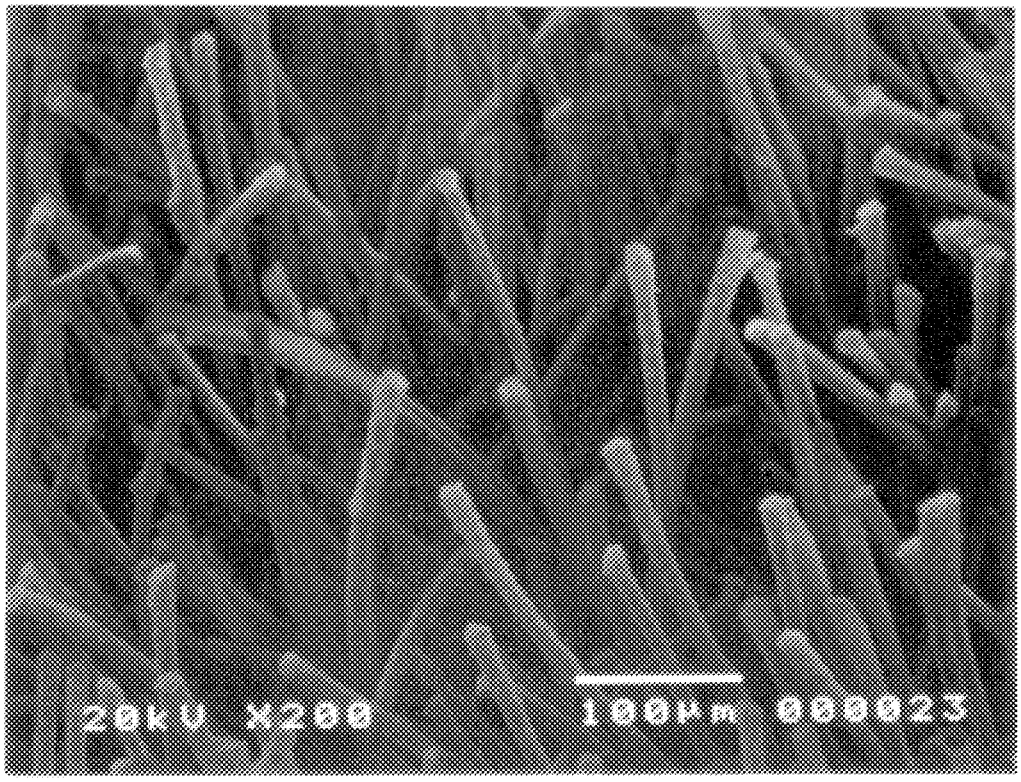
FIGS. 8A and 8B are photographs of portions of an abrasive sheet according to this invention showing abrasive particles attached to each of mutually separated threads (magnification=200 for FIG. 8A and 750 for FIG. 8B)
Figure 8B:
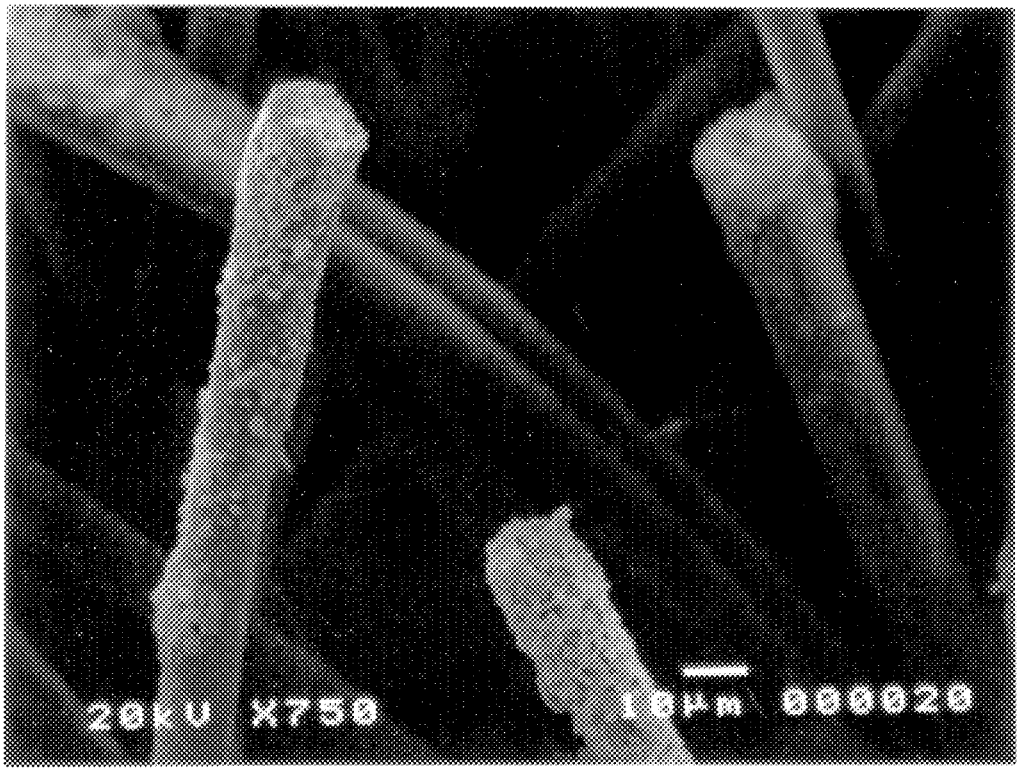
Figure 9A:
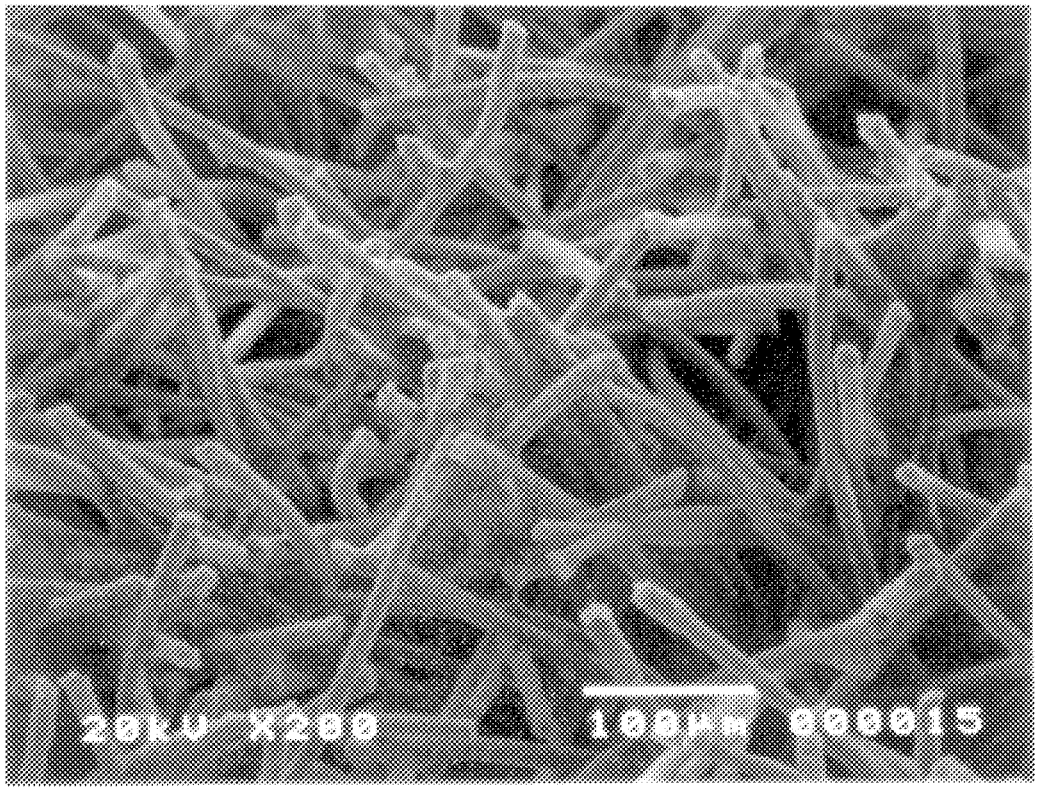
FIGS. 9A and 9B are photographs of portions of an abrasive sheet with a coating material attached to intersections of threads to form solid lumps (magnification=200 for FIG. 9A and 750 for FIG. 9B).
Figure 9B:
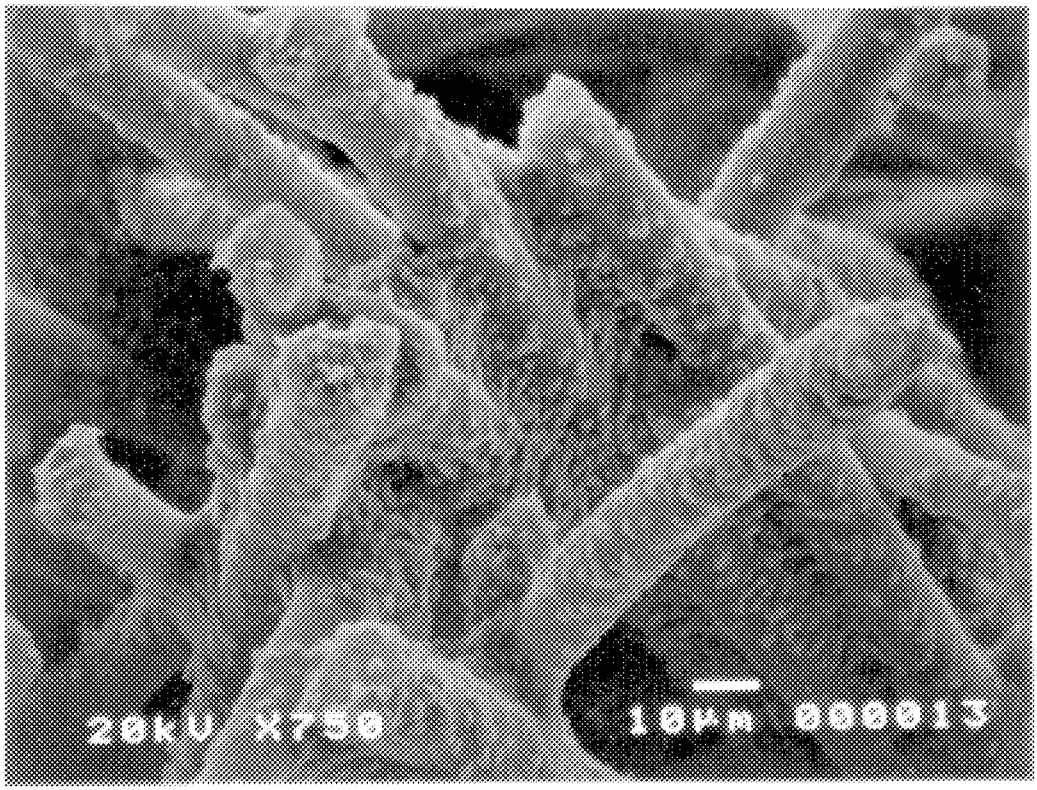

FIGS. 8A and 8B show abrasive particles attached to each of mutually separated threads, and FIGS. 9A and 9B show a coating material attached to threads where they intersect each other. These photographs clearly show that mutually separated threads can move more freely and flexibly than those forming lumps of a coating material and are capable of taking in debris, or abrasion chips, in the spaces among them.

In summary, abrasive sheets according to this invention are characterized as having independently separated threads each having abrasive particles evenly attached thereto such that the threads can move freely with an increased degree of freedom. As a result, the effective density of the abrasive particles which contact the workpiece surface to be processed increases. Thus, even if there are abrasive particles which are abnormally large or projecting excessively, the workpiece surface can be uniformly and evenly processed and the abrasion chips can be effectively removed, taken into spaces among the mutually separated threads. Since the distance on each thread to be coated can be adjusted according to this invention, abrasive sheets with different abrasive forces can be manufactured. Although the invention has been described above with reference to only a limited number of examples, these examples are not intended to limit the scope of the invention. The disclosure is intended to be interpreted broadly.

What is claimed is:

1. An abrasive sheet comprising:

a flexible base sheet;

mutually separated threads which are evenly planted on said base sheet; and abrasive particles attached evenly over a specified length of said threads, said threads being able to move freely and mutually independently when said abrasive sheet is used for abrading a workpiece surface and said threads being capable of taking in debris from said abraded workpiece surface in spaces thereamong.

2. The abrasive sheet of claim 1 wherein said threads comprises a fiber material selected from the group consisting of nylon, polypropylene, polyethylene and polyethylene terephthalate.

3. The abrasive sheet of claim 1 wherein said threads are 0.1–10 d in diameter and 0.1–1.0 mm in length and 50–2000 of said threads are planted per $mm^2$ of said base sheet.

4. The abrasive sheet of claim 1 wherein said abrasive particles comprise a material selected from the group consisting of $Al_2O_3$, SiC, diamond, $Cr_2O_3$ and $CeO_2$.

5. The abrasive sheet of claim 1 wherein said binder comprises a hardening agent and a material selected from the group consisting of polyester resin, polyurethane resin, copolymerized vinyl resin, epoxy resin, phenol resin, mixtures thereof and water-soluble resins.

6. The abrasive sheet of claim 1 wherein said base sheet comprises a plastic film sheet of a material selected from the group consisting of polyethylene terephthalate, polyethylene naphthalate, polyphenylene sulfide, polyether imide, polycarbonate, polyvinyl chloride, polypropylene, polyvinylidene chloride, nylon, polyethylene and polyether sulfone.

7. A method of manufacturing an abrasive sheet, said method comprising the steps of:

providing a thread-planted sheet having threads planted evenly over a surface of an elastic sheet;

preparing a coating material by mixing abrasive particles and a binder; and coating said surface with said coating material such that said abrasive particles adhere evenly to said threads over a specified length from tips thereof such that said threads remain free to move independently with respect to one another and are capable of taken in abrasive chips in spaces thereamong when said abrasive sheet is used for abrading a workpiece surface.

8. The method of claim 7 wherein said threads comprises a fiber material selected from the group consisting of nylon, polypropylene, polyethylene and polyethylene terephthalate.

9. The method of claim 7 wherein said threads are 0.1–10 d in diameter and 0.1–10 mm in length and 50–2000 of said threads are planted per $mm^2$ of said elastic sheet.

10. The method of claim 7 wherein said abrasive particles comprise a material selected from the group consisting of $Al_2O_3$, SiC, diamond, $Cr_2O_3$ and $CeO_2$.

11. The method of claim 7 wherein said binder comprises a hardening agent and a material selected from the group consisting of polyester resin, polyurethane resin, copolymerized vinyl resin, epoxy resin, phenol resin, mixtures thereof and water-soluble resins.

12. The method of claim 7 further comprising the step of dissolving said binder in a solvent selected from the group consisting of toluene, xylene, MEK, MIBK, ethyl acetate, cyclohexane, acetone, alcohols, water, and mixtures thereof.

13. The method of claim 7 wherein said base sheet comprises a plastic film sheet of a material selected from the group consisting of polyethylene terephthalate, polyethylene naphthalate, polyphenylene sulfide, polyether imide, polycarbonate, polyvinyl chloride, polypropylene, polyvinylidene chloride, nylon, polyethylene and polyether sulfone.

14. The method of claim 7 wherein the viscosity of said coating material is 20–300 cp.

15. The method of claim 7 wherein the weight ratio of said abrasive particles is over 60%.

16. The method of claim 7 wherein said step of coating comprises the steps of:

heating and drying $Al_2O_3$ particles to serve as said abrasive particles, the weight ratio of said abrasive particles being 60–98%;

producing said binder by dissolving 1–35 weight % of saturated polyester resin into a mixed solvent of toluene, xylene, ethyl acetate and MEK; and adjusting the viscosity of said coating material to 30–150 cp by adding a hardening agent of isocyanate immediately before said coating step.

17. The method of claim 7 wherein said coating step is carried out by using a gravure coating apparatus having a gravure roller and a backup roller which are positioned opposite to each and spaced apart from each other.

18. The method of claim 17 wherein said coating step comprises:

adjusting the separation between said gravure roller and said backup roller according to a specified distance on said threads over which said coating material is intended to be applied;

coating said gravure roller with said coating material;

tensioning said thread-planted sheet on said backup roller to cause said threads to stand up towards said gravure roller; and causing said thread-planted sheet to travel between said gravure roller and said backup roller to thereby apply said coating material on said threads.

19. The method of claim 18 further comprising the step of causing said rotating said gravure roller such that the peripheral speed thereof is 40–90% of the speed of said thread-planted sheet between said gravure roller and said backup roller.

20. The method of claim 18 wherein the line density on said gravure roller is 50–200/inch, the depth thereof being 30–200 $\mu$m and the cell capacity thereof being 8–100 $cm^3/m^2$.

* * * * *